US005372484A

United States Patent [19]

Briggs et al.

[11] Patent Number: 5,372,484

[45] Date of Patent: Dec. 13, 1994

[54] FUEL DELIVERY SYSTEM FOR FUEL-BURNING HEATER AND ASSOCIATED COMPONENTS

[75] Inventors: Eugene C. Briggs, Bowling Green, Ky.; Wayne Robertson; Christopher L. Gansel, both of Nashville, Tenn.

[73] Assignee: Black Gold Corporation, Nashville, Tenn.

[21] Appl. No.: 970,932

[22] Filed: Nov. 2, 1992

[51] Int. Cl.[5] ..... F04B 49/00

[52] U.S. Cl. ..... 417/310; 417/440

[58] Field of Search ..... 431/265; 418/171; 417/310 O, 440 X

[56] References Cited

U.S. PATENT DOCUMENTS

| | | | |
|---|---|---|---|
| 2,904,107 | 9/1959 | Holthouse, Sr. et al. | 431/265 |
| 3,096,810 | 7/1963 | Martz | 431/265 |
| 4,715,800 | 12/1987 | Nishizawa et al. | 417/310 |
| 5,013,220 | 5/1991 | Nakagawa et al. | 417/310 |

*Primary Examiner*—Richard A. Bertsch
*Assistant Examiner*—Alfred Basichas
*Attorney, Agent, or Firm*—Michael E. McKee

[57] ABSTRACT

An oil-burning furnace including a combustion zone and a nozzle block assembly through which oil and pressurized air are introduced into the combustion zone utilizes an oil pump of trochoidal design for delivering oil to the combustion zone at a metered rate and a purge control for withdrawing oil from the nozzle block assembly upon shut down of the furnace operation. The flow rate at which the oil pump delivers the oil to the nozzle block assembly is relatively constant regardless of the weight or viscosity of the oil burned by the furnace, and the purge control cooperates with an air compressor used for delivering air, under pressure, to the nozzle block assembly and includes an expandable zone for extracting oil from the nozzle block assembly upon a de-energizing of the air compressor. The nozzle block assembly also includes a block providing an air passageway through which air is pumped from the air compressor into the combustion zone and an electric heating element disposed within the air passageway for heating air routed therethrough. Thermostats mounted within the nozzle assembly block ensure that the block is maintained within a preselected temperature range from the outset of furnace operation.

8 Claims, 4 Drawing Sheets

FUEL DELIVERY SYSTEM FOR FUEL-BURNING HEATER AND ASSOCIATED COMPONENTS

BACKGROUND OF THE INVENTION

This invention relates generally to furnaces which utilize fuel oil or waste oil as fuel and relates, more particularly, to the means with which fuel and air is delivered to the combustion zone of such a furnace for burning.

Prior art furnaces which burn fuel oil or waste oil in a combustion zone commonly include a nozzle block assembly utilizing an atomizing nozzle through which air and oil are conducted into the combustion zone for burning and a fuel pump and air compressor for delivering fuel and air, respectively, to the nozzle. It is preferred that fuel be delivered to the combustion zone at a metered, relatively constant flow rate to ensure that a proper mixture of fuel and oil is created within the zone throughout the operation of the furnace. However, factors such as the differences in the weights of oil used in such furnaces render it difficult for common fuel pumps, such as a pump of a gear and crescent design or a diaphragm pump, to deliver fuel at a metered rate. Some prior art furnace systems utilize pressure regulating devices for oil and air pressure control, but differences in the viscosity of oil used in any one furnace system may render such regulating devices incapable of providing an accurate, metered flow rate and may require readjustment between use of oils having different viscosities.

It is an object of the present invention to provide new and improved means for delivering fuel to the combustion zone of a furnace of this class at a metered flow rate.

An additional object of the present invention is to provide a new and improved furnace system within which such fuel delivery means are utilized.

Another feature of conventional furnaces of this class relates to the preheating of oil prior to its introduction into the combustion zone. While preheating of oil may be desirable in some instances, such preheating may present problems such as the formation of deposits within the fuel line.

Accordingly, another object of the present invention is to provide a new and improved preheating means for a furnace of this class which circumvents problems commonly associated with the preheating of oil prior to its introduction into the combustion zone.

Still another object of the present invention is to provide a new and improved furnace within which such preheating means are incorporated.

Yet another feature of conventional furnaces of this class relates to the presence of oil within the nozzle upon shut-down of the furnace operation. This oil may subsequently be cooked in the nozzle, which normally remains hot for an appreciable period of time following shut-down, or may migrate or drip from the nozzle into the combustion zone or onto the flame retention head located within the zone where deposits may build up.

Accordingly, a further object of the present invention is to provide new and improved means for circumventing problems commonly associated with furnaces of the prior art related to the presence of oil within the nozzle and the nozzle block upon shut-down of the furnace operation.

A still further object of this invention is to provide such means which purges oil from the nozzle and the nozzle block upon shut-down of the furnace operation.

A yet further object of the present invention is to provide a new and improved furnace within such purging means are incorporated.

SUMMARY OF THE INVENTION

This invention resides in a heating system including an oil-burning furnace having a combustion zone and components of the system utilized for delivering oil and air to the combustion zone.

In one aspect of the invention, the system includes a fuel line providing a passageway through which oil is routed to the combustion zone for burning, and a trochoidal pump is connected in the fuel line for delivering oil from a reservoir to the furnace at a metered, relatively constant flow rate regardless of the weight or viscosity possessed by the oil.

In another aspect of the invention, the furnace includes a nozzle assembly through which air and fuel are routed to the combustion zone of the furnace. The nozzle assembly comprises a body defining an air passageway through which air is conducted to the combustion zone and defining an oil passageway through which oil is conducted to the combustion zone and also includes an electric heating element supported within the air passageway and connectible to a power source for heating the air conducted through the air passageway during furnace operation.

In still another aspect of the present invention, the furnace utilizes a nozzle assembly through which air and fuel are routed to the combustion zone, utilizes an air compressor which delivers air under pressure to the nozzle assembly, an oil pump for pumping oil to the nozzle assembly and means for purging the nozzle assembly and means for purging the nozzle assembly of oil upon shut down of the operation of the air compressor and the oil pump.

DETAILED DESCRIPTION OF THE ILLUSTRATED EMBODIMENT

Figure 1:
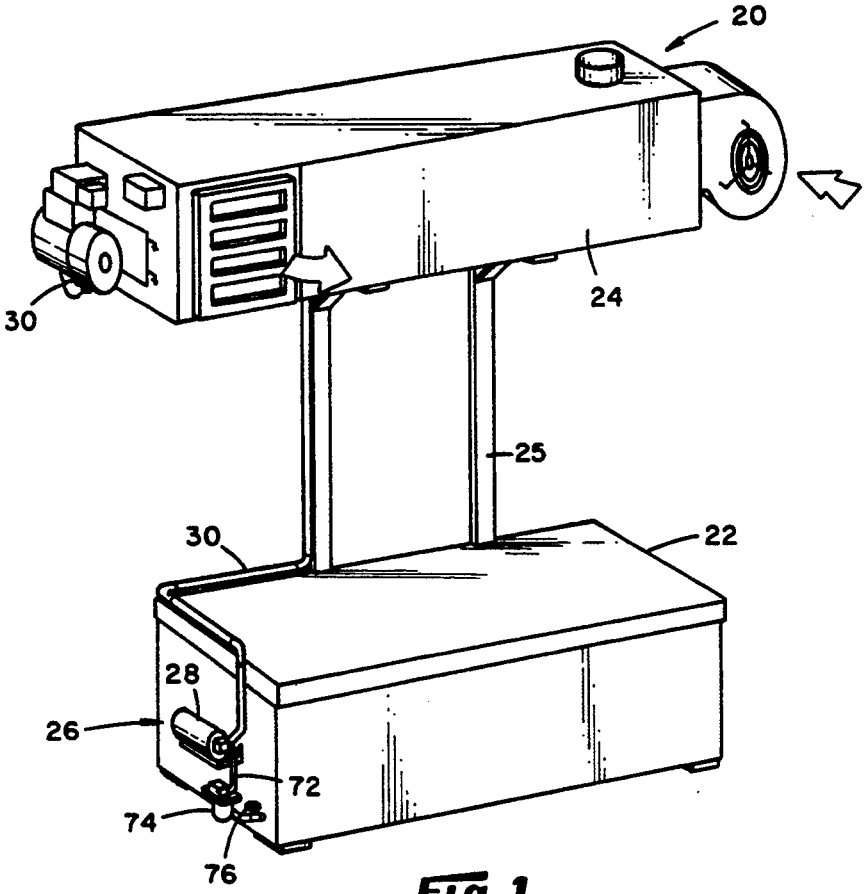
FIG. 1 is a perspective view of a waste oil-burning heating system within which features of the present invention are incorporated.

Turning now to the drawings in greater detail, there is illustrated in FIG. 1 a heating system 20 including an oil-burning furnace 24 within which waste oil is burned and a reservoir tank 22 within which oil is stored until burned in the furnace 24. The furnace 24 is supported in an elevated condition above the reservoir 22 by means of a stand 25. The system 20 also includes a fuel delivery system, generally indicated 26, including a pump assembly 28 disposed adjacent the reservoir 22 and a fuel line 30 joined between the reservoir 22 and the furnace 24. During operation of the heating system 20, oil is pumped through the fuel line 30 by the pump assembly 28 from the reservoir 22 to the furnace 24 at a metered, substantially constant flow rate.

Figure 2:
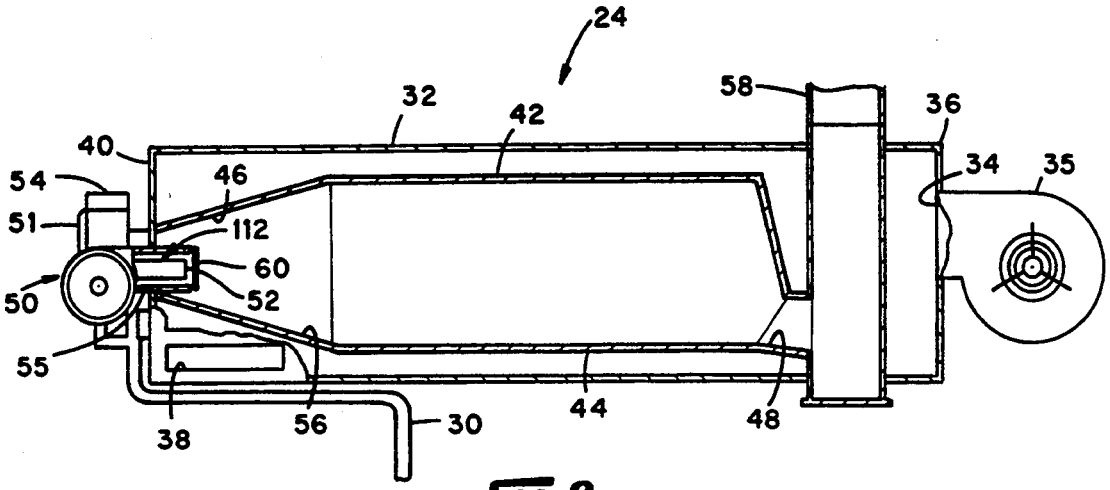
FIG. 2 is an elevational view, shown partially in longitudinal section, of the furnace of the FIG. 1 system.

As best shown in FIG. 2, the furnace 24 includes an elongated housing 32 having an air intake 34 adjacent one end 36 of the housing 32 and a discharge vent 38 adjacent the other end 40 of the housing 32, a circulating air blower 35 supported adjacent the intake end 36 of the housing 32, and a heat exchanger 42 having an elongated hollow body 44 supported axially along the housing 32. The heat exchanger body 44 includes an inlet end 46 through which oil and air are introduced into the heat exchanger body 44 for burning and an opposite outlet end 48. The furnace 24 also includes a burner assembly 50 supported by the housing 32 adjacent the vent end 40 for burning the oil within the heat exchanger 42 and an oil burner blower 51 for moving the products of combustion from the inlet end 46 of the heat exchanger body 44 toward the outlet end 48. The burner assembly 50 also includes an atomizing nozzle 52 for directing oil and compressed air into the heat exchanger body 44 and an air compressor 54 for delivering compressed air to the nozzle 52. An ignition transformer including electrodes 55 is supported adjacent the nozzle 52 for igniting the burner, and a flame retention head 60 is supported forwardly of the nozzle 52 for maintaining the flame of the burner adjacent the nozzle 52.

During use of the furnace 24, the oil which is introduced within the heat exchanger body 44 through the nozzle 52 is burned within a combustion zone 56 provided by the heat exchanger 42 so that the outer surface of the heat exchanger 42 is heated by the flame and attending combustion products moving through the heat exchanger body 42. The products of combustion are subsequently forced out of the heat exchanger 42 by way of a flue discharge conduit 58 connected to the outlet end 48 of the heat exchanger body 44. Air, such as room air, desired to be heated by the furnace 24 is forced by the circulating air blower 35 into the housing 32 through the intake end 36 so that the air flows between the outer surface of the heat exchanger 42 and the walls of the housing 32. As air is moved around the heat exchanger 42, it absorbs heat therefrom and subsequently exits the housing 32 through the discharge vent 38 in a heated condition. For a more detailed description of the structure and operation of the furnace 24, reference can be had to U.S. Pat. No. 4,955,359, the disclosure of which is incorporated herein by reference.

Figure 3:
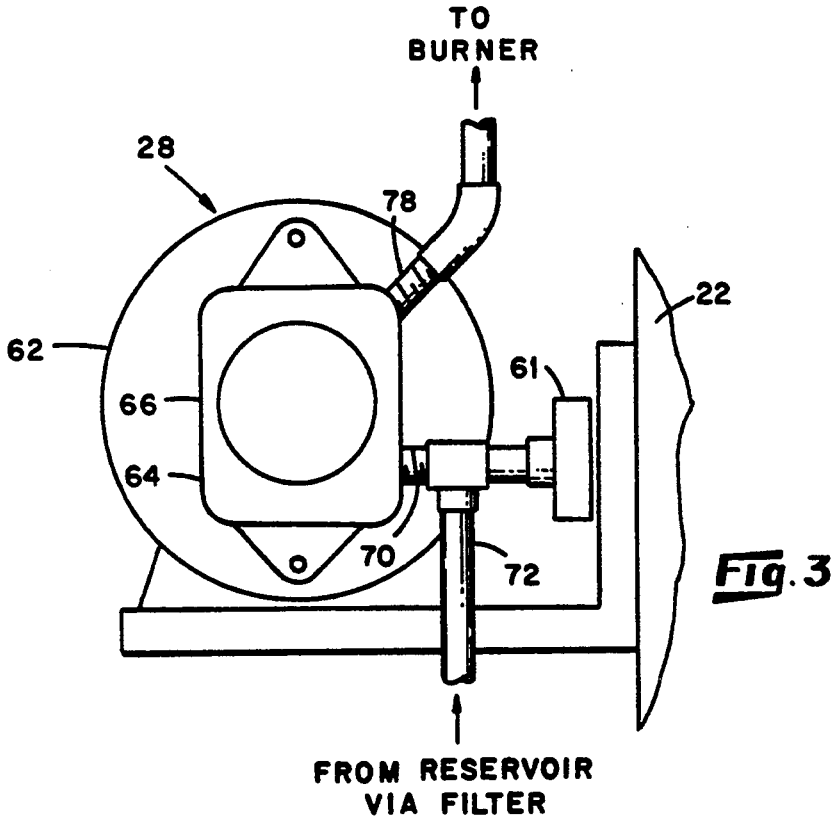
FIG. 3 is a side elevational view of a fragment of the FIG. 1 arrangement as seen generally from the front in FIG. 1.
Figure 4:
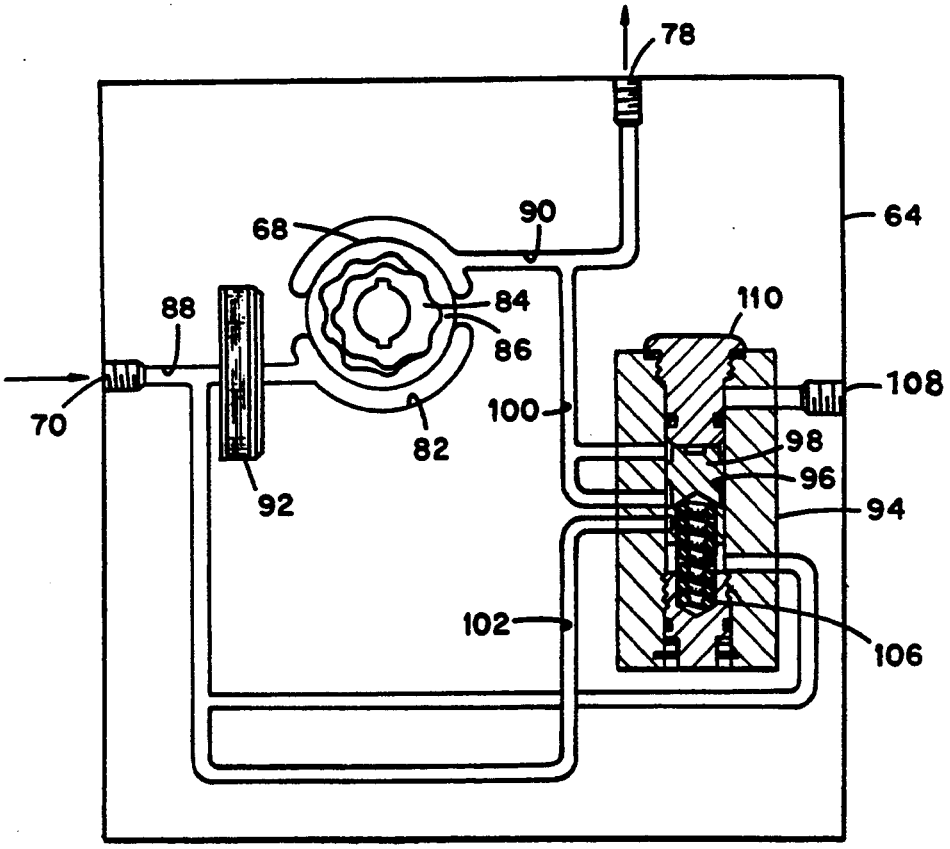
FIG. 4 is a schematic representation of the interior of the pump of the FIG. 3 fragment.

With reference to FIGS. 1, 3 and 4, the pump assembly 28 of the fuel delivery system 26 includes a motor 62 and a pump 64 positioned at one end of the motor 62. The pump 64 includes a housing 66 and an internal rotor 68 (FIG. 4) which is connected to the shaft of the motor 62, so that by energizing the motor 62, the rotor 68 is rotated by the motor shaft within the housing 66. As best shown in FIGS. 3 and 4, the pump housing 66 includes an inlet port 70 joined in flow communication with the interior of the reservoir 22 by means of a conduit 72 joined at one end to the reservoir 22 and joined at its opposite end to the pump housing 66. If desired, a filter assembly 74 and shut-off valve 76 can be positioned in-line with the conduit 72 for filtering the oil drawn from the reservoir 22 by the pump 64 and providing means for shutting off the oil flow through the conduit 72, and a vacuum gauge 61 can be connected adjacent the inlet port 70. The pump housing 66 also includes an outlet port 78 through which oil exits the housing 66.

The depicted pump 64 is a low-speed, positive displacement pump of a trochoidal design. Accordingly, the motor 62 is adapted to operate the pump 64 at a relatively low speed, e.g., between about 150 and 500 rpm, to reduce the likelihood of slippage, i.e., leakage of the oil between the components of the pump 64. Moreover, a low speed pump commonly requires less horsepower for operation (and wears and costs less) than does a high speed pump and is therefore advantageous for the smaller amount of energy needed for its operation. As shown in FIG. 4, the pump housing 66 includes an internal cavity 82 within which the rotor 68, i.e., a trochoidal rotor, is rotatably positioned. The rotor 68 includes a central member 84 and a planetary member 86 positioned about the central member 84. During operation of the pump 64, oil enters the low-pressure side, or the lower side as viewed in FIG. 4, of the cavity 82 and is acted upon by the rotating rotor 68 so that the oil exits the opposite side, or the higher side as viewed in FIG. 4, of the cavity 82 at a higher pressure.

The pump housing 66 also includes an inlet passageway 88 extending from the inlet port 70 and the cavity 82 for conducting the oil to the low-pressure side of the cavity 82 and an outlet passageway 90 extending from the high-pressure side of the cavity 82 to the outlet port 78. In the depicted pump 64, a filter screen 92 is disposed in the inlet passageway 88, and an internal valve 94 is positioned within the housing 66 for preventing the oil pressure on the high-pressure side of the cavity 82 from exceeding a predetermined level. The valve 94 includes an elongated passageway 96 and a spring-biased piston 98 positioned within so as to be movable along the length of the passageway 96. A passageway 100 joins the outlet passageway 90 to the valve passageway 96, and a passageway 102 joins the valve passageway 96 to the inlet passageway 88.

During normal operation of the pump 64, the piston 98 is positioned along the length of the valve passageway 96 so as to prevent communication between the passageways 100 and 102 and oil, under pressure, exits the outlet port 78 for conduction by the fuel line 30 (FIG. 1) to the furnace 24. However, upon a build-up of oil pressure, such as may occur if the nozzle 52 becomes clogged, at the high pressure side of the pump cavity 82 (FIG. 4) to a predetermined pressure, e.g., approximately 70 psig, the piston 98 is forced by the oil pressure along the length of the passageway 96 and against the force of the biasing spring, indicated 106 in FIG. 4, so that the passageways 100 and 102 communicate with one another through the valve passageway 96 thereby permitting oil contained within the passageway 100 to flow into the passageway 102 and thus to the inlet passageway 88. It follows that upon build-up of a pressure of about 70 psig on the high-pressure side of the cavity 82, the valve 94 redirects oil from the high-pressure side to the suction, or low-pressure, side of the pump 46 and circumvents the need for a pressure relief valve external of the pump 64.

The pump 64 has been found to be well-suited for delivering oil to the furnace 24 at a predetermined metered, substantially constant flow rate even though the oil of the reservoir 22 may possess a weight within a relatively broad range of fuel weights or a viscosity within a relatively broad range of viscosities. The capacity of the pump 64 to pump oils of different weights or varying viscosities at substantially the same metered rate can be readily appreciated in view of the fact that the waste oil contained within the reservoir 22 could possess any weight ranging from a relatively light weight to a relatively heavy weight. Therefore, regardless of the weight of the oil contained within the reservoir 22, the oil pumped through the furnace nozzle 52 (FIG. 2) for burning within the combustion zone 56 of the furnace 24 is delivered to the combustion zone 56 at substantially the same, constant metered rate so that the pressure of the air delivered to the combustion zone by the compressor 54 is less critical and the furnace 24 can be operated efficiently. Accordingly, the pump 64 circumvents the need for fuel and air pressure gauges which would commonly be used to continuously monitor the fuel and air delivery systems. Still further, the enhanced efficiency of the furnace 24 due to the pump 64 reduces soot build-up within the heat exchanger 42 and promotes a cleaner burning of the air/oil mixture.

The pump 64 is also capable of delivering oil through a head distance (as measured vertically between the pump 64 and furnace 24) of between about zero and twenty feet and prevents gravitationally-induced backflow of oil through the fuel line 30 upon shut-down of the pump 64 and therefore circumvents the need for check valves or solenoid valves normally required for this purpose.

Another advantage provided by the pump 64 relates to the fact that if the fuel line 30 becomes, on occasion, partially clogged, the build-up of pressure (to the pressure limit of the internal valve 94) at the high-pressure port 78 of the pump 64 is likely to be sufficient to unclog the fuel line 30 so that the flow of oil therethrough is permitted to return to the normal, metered flow rate. By comparison, conventional pump systems used in similar applications do not increase the oil pressure in a partially-clogged fuel line because the pressure within such systems are limited by a pressure regulator. Still further, the pump 64 circumvents the need for pressure regulating devices within the fuel line 30.

Preferably, the components, e.g. the rotor 68 and housing 66, of the pump 64 are constructed and assembled with close tolerance control to enhance the reliability of the pump 64. The depicted pump 64 has been modified from a pump which is a commercially available pump of trochoidal design. The commercial pump is provided with an outlet port 108 (FIG. 4) which is intended to be the high pressure port through which a liquid is pumped and is also provided with a bleed port through which the pump can be primed. However, to modify this commercial pump to provide the pump 64, the outlet port 108 is plugged by means of a plug 110 secured within the valve passageway 96 as shown in FIG. 4 and the bleed, i.e. priming, port is utilized as the outlet port 78. In addition, the spring of the spring-biased piston 98, which is normally adapted to open the valve 98 upon the sensing a fluid pressure (through passageway 100) of about 100 psig, is replaced with the spring 106 adapted to open the valve 94 upon the sensing of a fluid pressure (through the passageway 100) of about 70 psig. It has been found that the pump resulting from such a modification and operated at relatively low speed delivers oil to the nozzle 52 within a pressure range of about 2 to 7 psig, normally about 4 psig., and within a flow rate of between 1 and 4 gallons per hour.

Figure 5:
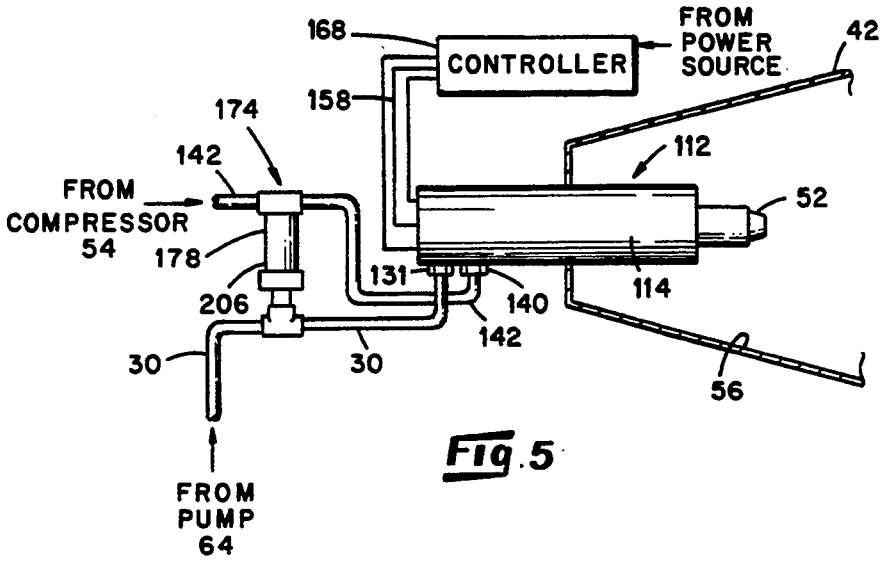
FIG. 5 is a fragmentary view illustrating schematically the nozzle assembly and purge assembly of the FIG. 1 heating system.
Figure 6:
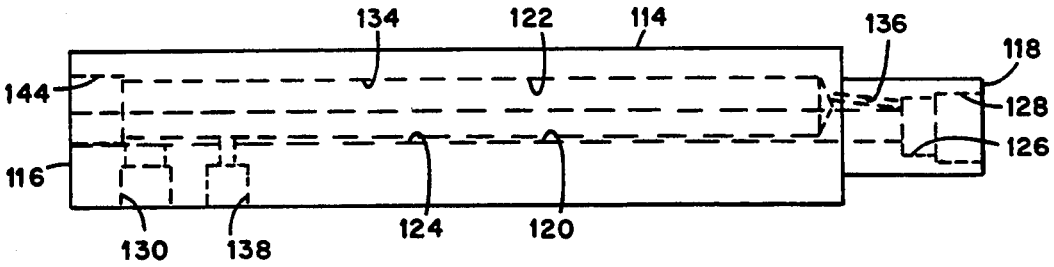
FIG. 6 is a side elevational view of the block of the nozzle assembly of FIG. 5.

With reference to FIG. 5, the furnace nozzle 52 is one component of a nozzle block assembly 112 supported adjacent the combustion zone 56 of the furnace 24. The nozzle block assembly 112 of the depicted furnace 24 includes a body, or block 114, constructed of aluminum or other suitable material within which the nozzle 52 is mounted and through which oil and air from the pump 64 and compressor 54, respectively, are routed to the nozzle 52. As best shown in FIG. 6, the block 114 includes two opposite ends 116, 118 and an oil passageway 120 and an air passageway 122. The oil passageway 120 is provided, in part, by a bore 124 extending substantially centrally through the block 114 from the block end 116 to a location adjacent the opposite block end 118. At the opposite end 118, an enlarged bore section 126 communicates with the central bore 124 and is internally-threaded at the bore entrance 128 adjacent the block end 118. The remainder of the oil passageway 120 is provided by an access bore 130 formed in one side of the block 114 so as to communicate with the central bore 124. Provided at the entrance of the access bore 130 is an internally-threaded section for threadably receiving a fitting 131 (FIG. 5) used for joining the fuel line 30 to the nozzle block 114. The entrance of the central bore 124 adjacent the block end 116 is closed by a plug 132 (FIG. 7) secured therein.

With reference again to FIG. 6, the air passageway 122 of the block 114 is provided, in part, by a longitudinal bore 134 extending from the block end 116 to a location adjacent the opposite block end 118 and a smaller bore 136 providing communication between the bore 134 and the enlarged bore section 126. An access bore 138 is formed in one side of the block 114 so as to communicate with the longitudinal bore 134, and the entrance of the access bore 138 is provided with an internally-threaded section for threadably receiving a fitting 140 (FIG. 5) used for joining the air conduit, indicated 142 in FIG. 5, to the nozzle block 114. The entrance of the longitudinal bore 134 adjacent the block end 116 is provided with a threaded entrance 144 for accepting and attaching an electric heater element 152 inserted therein.

Figure 7:
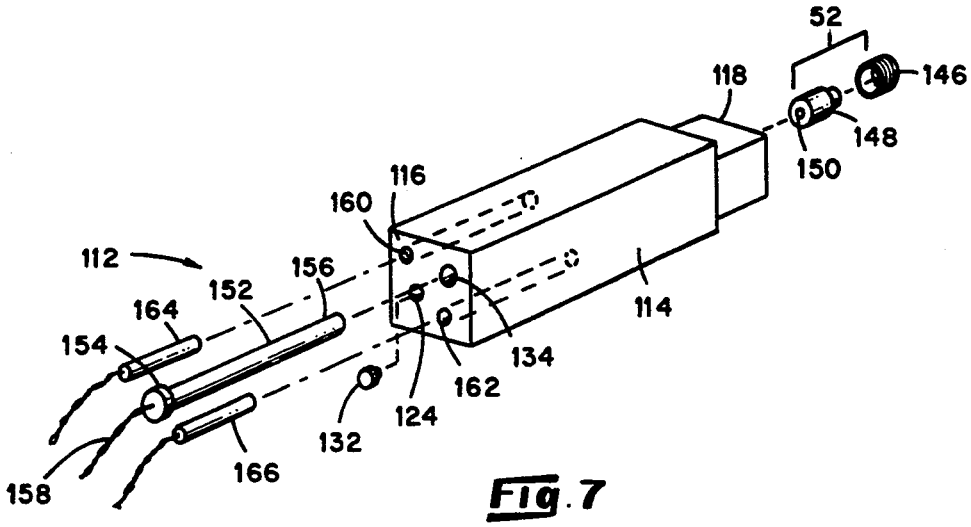
FIG. 7 is a perspective view of the nozzle assembly of FIG. 5, shown exploded.

As shown in FIG. 7, the nozzle 52 is a multi-pieced unit having a securement member 146 for threadably securing the nozzle 52 within the entrance 128 (FIG. 6) of the bore section 126 of the block 114 and a central member 148 retainably positioned within the bore entrance 28 by the securement member 146 and which includes a central through-opening 150. When the nozzle 52 is secured within the block 114 and the furnace 24 is in operation, the oil flowing through the oil passageway 120 (FIG. 6) exits the nozzle 52 through the through-opening 150, and air flowing through the air passageway 122 (FIG. 6) enters the enlarged bore section 126 and exits the nozzle 52 through suitable passageways provided about the through-opening 150 of the central member 148.

Figure 8:
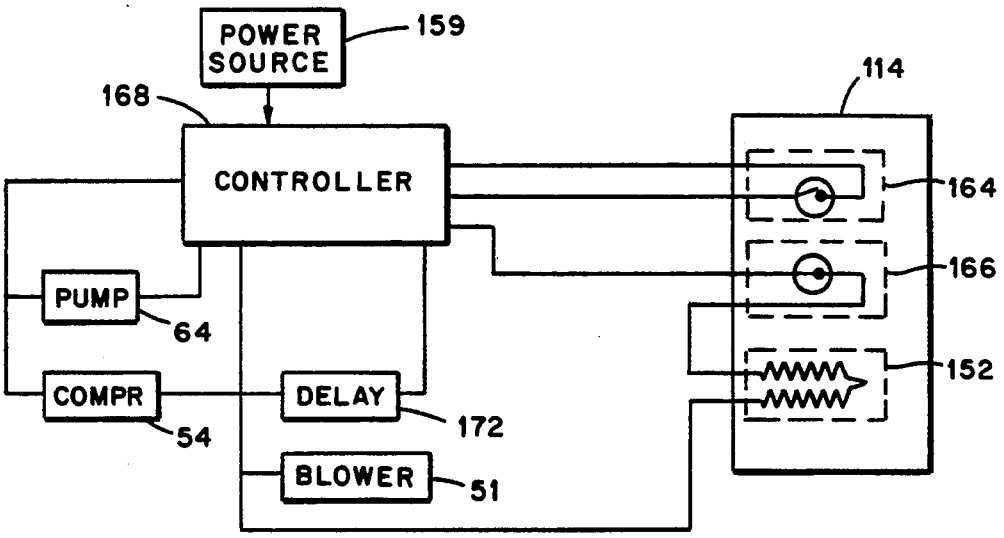
FIG. 8 is a schematic view illustrating in block diagram form the wiring of the FIG. 1 heater system.

The nozzle block assembly 112 also includes the immersion electric heater element 152, introduced earlier, secured within the longitudinal bore 134 of the air passageway 122. As best shown in FIG. 7, the heater element 152 includes a base 154 adapted to be sealingly secured within the threaded entrance 144 of the longitudinal bore 134 and an elongated resistance element 156 joined to so as to extend from the base 154. When secured within the longitudinal bore 134, the resistance element 156 extends for a substantial distance into the bore 134 and its outer surface is spaced from the interior walls of the bore 134. During heater operation, air pumped by the compressor 54 through the air passageway 122 flows between the walls of the bore 134 and the surface of the element 156 so as to contact and absorb heat from the element 156. The air thereafter flows out of the nozzle 52 in a heated condition where it is used for burning the atomized oil in the combustion zone 56 of the furnace 24. Thus, the depicted nozzle block assembly 112 directly heats air, rather than oil, routed through the block to facilitate the burn adjacent the nozzle 52 and circumvents problems, e.g. carbonization or build-up of a varnish, commonly attending the preheating of oil. Power to the element 156 is provided through wires 158 extending through the base 154 and connected to a power source 159 (FIG. 8). The heater element 152 of the depicted nozzle block assembly 112 is rated at about 400 watts and heats the air moving through the air passageway 122 to about 400° F.

With reference still to FIG. 7, the nozzle block 114 also includes two bores 160, 162 extending about midway through the block 114 from the block end 116. Positioned within the bores 160, 162 are two temperature control thermostats 164, 166 positioned in heat exchange relationship with the block 114 for monitoring the temperature thereof in a manner described herein. Each thermostat 164 or 166 can be secured within a corresponding bore 160 or 162 with a plug of silicone rubber adhesive or another suitable material. The thermostats 164, 166 are part of a control system within the furnace 24 which permits the metering pump 64 to operate only if the temperature of the block 114 is within a preselected temperature range. In this connection and with reference to FIG. 8, this control system includes a controller 168 including a control circuit within which the electric heater element 152 and thermostats 164 and 166 are wired. One thermostat 164 is normally-opened and adapted to close when the temperature of the block 114 is raised to about 160° F. The other thermostat 166 is normally-closed and adapted to open if the temperature of the block 114 rises above about 200° F. so as to shut off power to the element 152.

Upon energizing the furnace 24, through, for example, a room thermostat, power is supplied to the heater element 152 so that the nozzle block 114 is heated by the element 152 (primarily by radiant heat emitted therefrom), but the thermostat 164 prevents the metering pump 64 and the ignition transformer, as well as the air compressor 54 and burner blower 51, from operating until the temperature of the block 114 reaches about 185° F. When the block 114 attains the temperature of about 185° F., the thermostat 164 closes and the pump 64, burner blower 51 and air compressor 54 are switched ON. Such a feature ensures that air routed through the block 114 from the compressor 54 is preheated by the element 152 from the outset of compressor operation. The thermostat 166, on the other hand, acts to prevent the overheating of the block 114 and, accordingly, shuts off power to the element 152 if the block temperature exceeds about 206° F. With reference still to FIG. 8, the furnace control circuit also includes a time delay relay 172 for continuing the operation of the burner blower 51 and compressor 54 for a short period of time following de-energization of the pump 64 to cool the nozzle block 114 following a burn cycle of the furnace operation.

Figure 9:
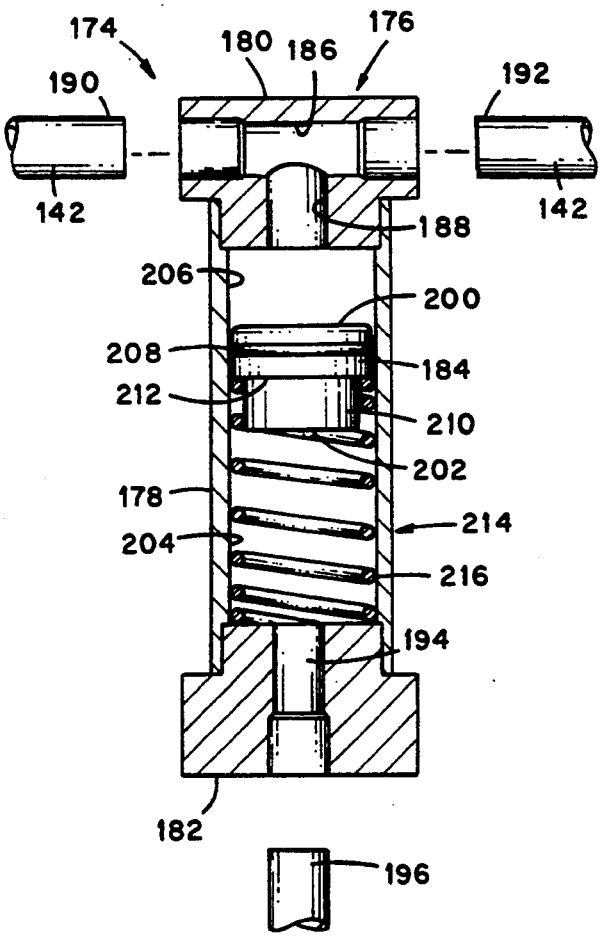
FIG. 9 is a longitudinal cross-sectional view of the purge assembly of FIG. 5 illustrating the piston of the purge assembly when positioned in one position.

With reference again to FIG. 5, the fuel delivery system 26 also includes means, generally indicated 174, for purging the nozzle block assembly 112 of oil upon shut-down of the furnace operation. To this end, the purging means 174 includes a purge control 176 connected in a manner described herein between the air conduit 142 leading from the air compressor 54 to the nozzle block assembly 112 and the fuel line 30. As best shown in FIG. 9, the purge control 176 includes an elongated housing 178 having a hollow interior, end caps 180, 182 attached at opposite ends of the housing 178 and a piston 184 slidably disposed within the interior of the housing 178. The piston 184, housing 178 and end caps 180, 182 can be constructed of a suitable metal, such as aluminum or brass.

One end cap 180 is adapted to be connected in-line with the air conduit 142 leading from the high-pressure side of the compressor 54 so that the interior of the housing 178 is exposed to the pressurized air exiting the compressor 54. For this purpose, the depicted end cap 180 provides a T-fitting wherein the arms of the T are provided by a through-opening 186 opening out of the opposite sides of the cap 180 and the leg of the T is provided by a linear passageway 188 oriented at a right angle to the through-opening 186. The air conduit 142 is provided with two opposing end portions 190, 192, and these end portions 190, 192 are sealingly secured within the opposite ends of the through-opening 186. The other end cap 182 is provided with a through-opening 194 opening into the interior of the housing 178. A conduit section 196 is sealingly secured at one end within the through-opening 194 of the end cap 182 and is sealingly secured at its other end within a leg of a T-fitting 198 (FIG. 5) disposed along the fuel line 30 so that the interior of the housing 178 communicates with the fuel line 30 through the conduit section 196.

The hollow interior of the housing 178 is cylindrical in form, and the piston 184 is positioned within the housing interior for sliding movement therealong. The piston 184 includes a body having two opposite faces 200, 202 which separate the housing interior into first and second variable-volume chambers 204 and 206, respectively. The piston body also includes an annular groove within which an O-ring 208 is positioned for sealingly separating the chambers 204, 206 from one another and a reduced portion 210 which extends from the piston face 202 and terminates in a shoulder 212.

Figure 10:
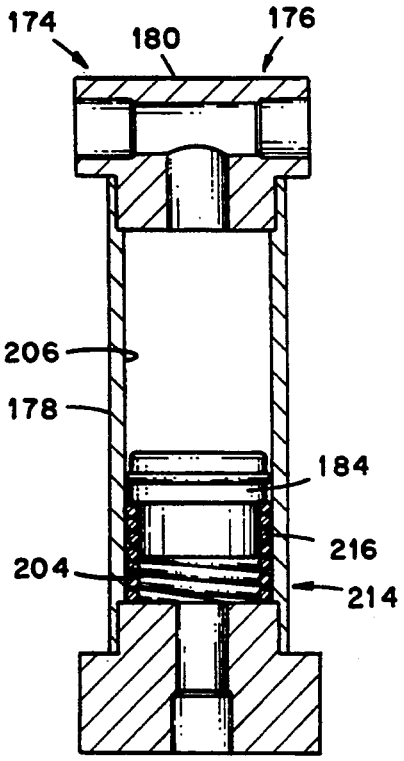
FIG. 10 is a view similar to that of FIG. 9 of the FIG. 5 purge assembly illustrating the piston of the purge assembly when positioned in another position.

The piston 184 is slidably movable along the length of the housing 178 between the position illustrated in FIG. 9 and the position illustrated in FIG. 10. When the piston 184 is positioned in the FIG. 10 position, the first variable-volume chamber 204 possesses one, i.e., relatively small, volume, and when the piston 184 is positioned in the FIG. 9 position, the first variable-volume chamber 204 possesses another volume which is greater than that of the aforementioned one volume.

The purge control 176 also includes means, indicated 214 in FIGS. 9 and 10, for biasing the piston 184 from the FIG. 10 position toward the FIG. 9 position. In the depicted control 176, the biasing means 214 is in the form of a steel compression spring 216 encircling the reduced portion 210 of the piston 184 and interposed between the piston shoulder 212 and the end cap 182. The spring 216 is sized so that when in a relaxed condition (as illustrated in FIG. 9) the piston 184 is disposed adjacent the end cap 180.

Prior to start-up of the furnace 24, the piston 184 is positioned in the FIG. 9 relaxed condition. Upon start-up of the furnace 24, or more specifically, the energizing of the air compressor 54, the piston 184 is suddenly exposed to the pressurized air exiting the compressor 54 and moving through the air conduit 142 so that the piston 184 is forcibly moved from the FIG. 9 position to the FIG. 10 position in opposition to the force of the spring 216. The pressure of the air moved through the air conduit 142 of the depicted system 20 is about 9 psig, and the pressure of the oil moved through the fuel line 30 is about 4 psig so that about differential of about 5 psi exists between the first and second chambers 204 and 206. Accordingly, the strength of the spring and the pressure of oil within the fuel line 30 accommodates the forced movement of the piston 208 to the FIG. 9 position upon exposure of the housing chamber 206 to the air, under pressure, flowing through the air conduit 142. The continued exposure of the piston 184 to the pressurized air during the operation of the furnace 24 maintains the piston 184 in the FIG. 10 position so that for the duration of operation of the compressor 54, the volume of the first variable-volume chamber 204 is relatively small.

Upon shut-down of the furnace 24, or more specifically, the de-energizing of both the metering pump 64 and the air compressor 54, the forced movement of fuel through the fuel line 30 ceases and the pressure of the air contained within the air conduit 142 drops to atmospheric pressure. Consequently, the piston 184 is permitted to return to its FIG. 9 position under the influence of the spring 216 so that the first variable-volume chamber 204 expands to the enlarged, FIG. 9 condition. This expansion of the first variable-volume chamber 204 draws fuel from the fuel line 30 and rearwardly of the nozzle block 114 so that the oil passageway 120 of the nozzle block 114 is emptied of oil and so that the chamber 204 is partially filled with oil. Accordingly, the increase in volume of the chamber 204 upon movement of the piston 184 from the FIG. 10 position to the FIG. 9 position is at least as great as the internal volume of the oil passageway 120 of the nozzle block 114. As best shown in FIG. 5, the purge control 174 is disposed in such a relation to the nozzle block assembly 112 so that the first variable-volume chamber 206 is disposed at a lower horizontal elevation than that of the nozzle block 114 to facilitate the withdrawal of oil by the chamber 206 and to maintain the oil within the chamber 206 until a subsequent cycle, or start-up of the pump 64 and air compressor 54.

By withdrawing the oil from the nozzle block 114 (which normally remains in a heated condition following furnace shut-down), the oil is prevented from cooking within the nozzle block 114 and is also prevented from migrating or dropping out of the nozzle 52 in a manner which could otherwise lead to build-up of deposit on the flame retention head 60 (FIG. 2). Another advantage provided by the purge control 176 relates to the added surge of fuel through the nozzle 52 upon start-up of the furnace 24. More specifically, upon energizing of the air compressor 54 and the metering pump 64, the piston 184 is forced downwardly to the FIG. 10 position thereby forcing the oil from the chamber 204 and into the fuel line 30. This added surge of fuel into the fuel line 30 supplements the pump-induced movement of oil through the nozzle 52 so that upon furnace start-up (and until the piston 184 of the control 176 reaches its FIG. 10 condition of equilibrium), the rate of oil flowing through the nozzle 52 is increased and fuel ignition is facilitated.

It will be understood that numerous modifications and substitutions can be had to the aforedescribed embodiment without departing from the spirit of the invention. For example, although the aforedescribed purge control 176 has been shown and described as including a spring-biased piston 184 which is slidably movable along the length of a housing 178, a furnace system in accordance with the broader aspects of this invention may utilize an elastomeric diaphragm which separates the internal cavity of a housing into two variable-volume chambers and wherein the diaphragm is biased from a position at which one chamber possesses a predetermined, small volume to a position at which the one chamber possesses a larger volume. Accordingly, the aforedescribed embodiment is intended for the purpose of illustration and not as limitation.

We claim:

1. In a fuel-delivery system for delivering fuel from a reservoir to a waste oil-burning furnace including a fuel line providing a passageway through which waste oil is routed from the reservoir to the furnace for burning and wherein the waste oil adapted to be burned by the furnace can include first and second quantities of waste oil wherein the weight and viscosity of the first and second quantities differ from one another, the improvement comprising:

a trochoidal pump connected in the fuel line for delivering the waste oil fuel from the reservoir to the furnace, the trochoidal pump having a housing, a rotor rotatably mounted within the housing for cooperating with the housing to deliver the waste oil to the furnace at a metered rate without the use of a pressure regulator for maintaining the pump discharge at a constant pressure level and independent of the weight or viscosity of the oil to be delivered when the pump is operated at a constant, specific rotor speed of between about 150 and 500 rpm so that as the weight and viscosity of the waste oil moving through the pump vary due to differing weights and viscosities of the waste oil fuel, the flow rate of the waste oil fuel delivered by the pump at the constant, specific rotor speed is constant.

2. The improvement as defined in claim 1 wherein the trochoidal pump is a positive displacement pump which is disposed adjacent the reservoir so that oil delivered by the pump to the furnace is pushed along the fuel line by the pump.

3. The improvement as defined in claim 1 wherein the trochoidal pump includes an internal relief valve which re-routes oil from the high-pressure side of the pump back to the suction side of the pump upon an increase of the pressure at the high-pressure side of the pump beyond a predetermined limit.

4. The improvement as defined in claim 1 wherein the construction and assembly tolerances of the rotor and housing of the pump are relatively close.

5. The improvement as defined in claim 1 wherein the construction and assembly tolerances of the rotor and housing of the pump are relatively close.

6. In a waste oil-burning furnace system including means providing a combustion zone within which waste oil is burned, a reservoir for containing waste oil and means for delivering waste oil contained within the reservoir to the combustion zone and wherein the waste oil adapted to be burned in the combustion zone can include first and second quantities of waste oil wherein the weight and viscosity of the first and second quantities differ from one another, the improvement characterized in that:

the oil delivering means includes a trochoidal pump for pumping the waste oil from the reservoir to the combustion zone, the trochoidal pump having a housing and a rotor rotatably mounted within the housing, and the housing and rotor cooperate with one another to pump waste oil to the furnace at a metered, substantially constant flow rate without the use of a pressure regulator for maintaining the pump discharge at a constant pressure level and independent of the weight or viscosity of the oil to be pumped when the pump is operated at a constant, specific rotor speed of between about 150 and 500 rpm so that as the weight and viscosity of the waste oil moving through the pump vary due to differing weights and viscosities of the waste oil fuel, the flow rate of the waste oil pumped by the pump at the constant, specific rotor speed is constant.

7. The improvement of claim 6 wherein the trochoidal pump includes an internal pressure-relief valve adapted to return oil from the high-pressure side of the pump to the suction side thereof when the pressure of the oil at the high-side pressure of the pump exceeds a predetermined value.

8. The improvement as defined in claim 6 wherein the construction and assembly tolerances of the rotor and housing of the pump are relatively close.

* * * * *